United States Patent [19]

Bente

[11] 4,366,632

[45] Jan. 4, 1983

[54] GRIPPING ELEMENT FOR FOOTWEAR

[75] Inventor: Alfred Bente, Herzogenaurach, Fed. Rep. of Germany

[73] Assignee: adidas Sportschuhfabriken Adi Dassler KG, Fed. Rep. of Germany

[21] Appl. No.: 231,740

[22] Filed: Feb. 5, 1981

[30] Foreign Application Priority Data

Feb. 13, 1980 [DE] Fed. Rep. of Germany ..... 3005261

[51] Int. Cl.[3] ..... A43C 15/00; A43B 5/02

[52] U.S. Cl. ..... 36/67 D; 36/128; 36/134

[58] Field of Search ..... 36/67 R, 67 A, 67 B, 36/67 C, 67 D, 59 R, 59 C, 126, 127, 128, 129, 134

[56] References Cited

U.S. PATENT DOCUMENTS 1,559,450 10/1925 Oakley ..... 36/59 C
2,336,632 12/1943 Park ..... 36/67 D

FOREIGN PATENT DOCUMENTS 2535624 7/1976 Fed. Rep. of Germany ..... 36/67 D
2820381 11/1979 Fed. Rep. of Germany ..... 36/67 D
533549 2/1941 United Kingdom ..... 36/67 D

*Primary Examiner*—Richard J. Scanlan, Jr.
*Attorney, Agent, or Firm*—Louis E. Marn; Elliot M. Olstein

[57] ABSTRACT

The invention is with respect to a gripping element for athletic and sporting footwear, as for example for football footwear. The gripping element takes the form of a bell, which is made of an elastically yielding material so that the downwardly facing edge of the gripping element may be bent when the element is forced against the ground by the weight of the user. For this reason, the gripping element is such that it may be used not only on soft, but furthermore on hard, as for example frozen ground. More specially, the gripping element may be made part of a compound structure, with a conventional cleat within it, such a structure having better gripping powers, more specially in the case of soft, sponge-like ground.

1 Claim, 3 Drawing Figures

GRIPPING ELEMENT FOR FOOTWEAR

BACKGROUND OF THE INVENTION

The present invention is with respect to a gripping element of elastically yielding material, and to a compound gripping structure made up of such a gripping element and a cleat, which may be of conventional design, for athletic footwear, such as footwear for football and soccer.

Gripping elements for athletic footwear for playing field games such as football, soccer, Rugby football and the like have to have the effect of so stepping up the gripping properties of the sole that the player is able at all times to make full use of the force and power of his legs for suddenly speeding up, slowing down and turning his body without slipping on the ground. For such purposes, cleats or other gripping elements are used, which may be fixed to the sole permanently or so that they may be taken off and changed over as needed. Although there are many different sizes and forms of such cleats, there are, however, certain limits to the function in this respect as fixed by the rules of the game played, such limits being with respect to the length of the gripping elements and to the effect that their outer face has to be such as not to be a danger to other players. As is general knowledge, conventional designs of cleats do not give the desired degree of grip in all extreme conditions or under more than one extreme condition, as for example on completely smooth, frozen-over fields and, on the other hand, on very soft, sponge-like wet earth or even soft snow. Putting it differently, presently offered cleats are a somewhat poor compromise and in such extreme conditions are of little use and only have a second-rate gripping effect.

While it is true that for frozen playing fields "ice cleats" have been offered and used, which are made of an elastically giving material such as a generally soft quality rubber with a greater diameter than is normal for footwear cleats and with a lower toothed or square-patterned working face, such cleats have turned out to have marked shortcomings when an attempt is made at playing on very soft fields.

Short outline of the invention

One purpose of the present invention is that of designing a gripping element, and more specially a compound structure made up of a gripping element and a cleat within it, for football footwear or the like, which, not only on hard ground, but furthermore, and more specially, on soft or snow-covered ground, has better gripping properties than gripping elements which have so far been offered by the footwear industry.

For effecting this purpose and further purposes, the gripping element of the present invention is made of a yielding material and has a bell-like body part with an edge running round a hollow in it, the body part being designed to be fixed to a footwear sole with the edge turned away from the sole. Because the gripping element is made of an elastically giving material, for example of soft quality rubber, its bell wall or skirt placed round the hollow within it may be readily bent and changed in form under the weight of the user. More specially, the free edge of the gripping element will be equal to all conditions of the playing ground, for example in the case of a very hard playing surface. Because, however, the edge of the gripping element is in the form of a complete ring, the element is strong enough to fully take up the forces acting on it. Because of its elastically giving properties, the edge of the gripping element will be forced outwardly along its circumference, if the edge is made thin, as in one working example of the invention, or the element will be caused to take on an outwardly more or less symetrically bulged form if, as in a further working example of the invention, the edge is made thick, with the outcome that the gripping element will be firstly bent one way and then the other all the time the footwear is being used so that for this reason, any mud accumulation on or within the gripping element will be broken up and pushed off again.

A specially good effect is produced if the gripping element of the present invention has within it a conventional cleat or stud as used on football shoes or the like to give a compound gripping structure or cleat in such a way that the cleat, because of its length, will be extending out for some part of its length past the edge of the gripping element. With this compound structure, better gripping properties and a higher level of anti-slip effect will be produced, because of the greater area contacting the ground as offered by the gripping element skirting the cleat, A further cause for such better properties would, however, seem to be because the gripping element, which is forced open somewhat round the cleat on the ground, has the effect of somewhat pushing together and compressing the ground material locally round the cleat so that the cleat gets a better grip.

Although gripping elements for track shoes have been put forward, which, when judged by eye only, would seem to be somewhat like the present invention in form as noted so far (see for example German Offenlegungsschrift specification 2,225,143), such past designs of gripping elements are in fact only designed for use of such track shoes on synthetic resin tracks and furthermore are made up of a hard material, which, generally speaking, is virtually undeformable by the forces in question so that looked at from a technical angle such elements may be seen to be generally different in function. They do not have such properties that they may be used for athletic shoes for games played on playing fields.

The gripping element or the compound structure of the gripping element and its inner cleat of the invention is best designed so that it may be fixed to the sole of football footwear or the like on the same lines as a conventional cleat. It would, however, be possible for the gripping element to be made in one piece, and of the same material, with the sole, which would then be a studded integral structure. On the same lines, in the case of the compound structure made up of the gripping element and the cleat, the first-named may be designed for use with a conventional cleat on the sole of football footwear together with a normal cleat as a two-piece structure, although it is quite possible for the gripping element and the cleat within it to be made in one piece. The gripping element may be made of rubber, polyurethane or the like. The materials used are best such as to have a relatively high tear strength and high elasticity so that the edge, in the form of a complete ring, of the gripping element takes up the forces acting on it as long as possible without damage and the elastic change in form of the gripping element desired in the present invention, will take place.

The gripping element of the present invention is more specially useful as part of the compound structure (gripping element and cleat) or combination we have noted. This is because the gripping element may be used under extreme ground conditions. The gripping element may be fixed to the sole of the footwear by way of a fixing screw of a cleat, running through a wall at the top end of the gripping element. The height of the gripping element is, in this case, such that the cleat will have about half to 4/5 of its length sticking out past the edge of the gripping element. In this respect, the wall thickness of the gripping element and/or its deformability, which is dependent on the selection of the material, has a connection with, and is dependent on, the gripping element height. In the case of generally low gripping elements, the wall thickness will be thinner and/or the material be less stiff than is the case with higher gripping elements, which are less stiff and more giving because of the wall extending for a longer distance along the cleat.

Further useful effects and measures of the present invention will be seen from the account now to be given of working examples, to be seen in the figures, and from the dependent claims. Inasfar as parts and structures to be seen in the figures are not detailed in the specification, they are nevertheless part of the disclosure supporting the claims.

DETAILED DESCRIPTION OF PREFERRED EMBODIMENTS

Figure 1:
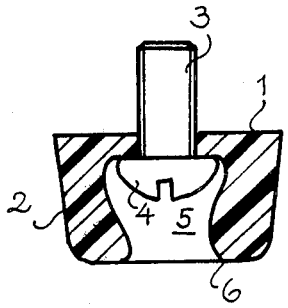
FIG. 1 is a view of a first working example of a gripping element of the invention.

The gripping element to be seen in FIG. 1 has, as may be seen from the drawing, a generally bell-like body with a generally flat end wall 1 and a wall 2 or skirt becoming somewhat narrower in a downward direction because it is conical. A fixing screw 3 is run through a hole in wall 1, the head 4 of the screw being completely taken up within the hollow 5 of the gripping element so that the acting face of head 4 is resting against the flat inner side of the wall 1. As the reader will be able to see from the figure, the inner face of the skirt or wall 2 is curved in lengthwise section so that the edge 6 is somewhat thicker than the rest of the wall. The gripping element is preferably made up of a tough and elastic, yielding polyurethane material, for example one marketed under the tradename of "Vulkollan", which is registered.

The gripping element of FIG. 1 is circular is cross-section and takes the form of a slice or frustum of a cone. The gripping element on these lines, which may be generally used, has for example a diameter of the wall 1 of 18.5 mm and an outer diameter at the edge 6 of 12.7 mm. The cross-section might furthermore be oval or polygonal, if desired.

Figure 2:
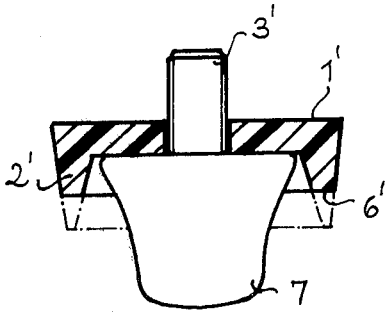
FIG. 2 is a view of a compound structure made up of a cleat and a different form of gripping element.
Figure 3:
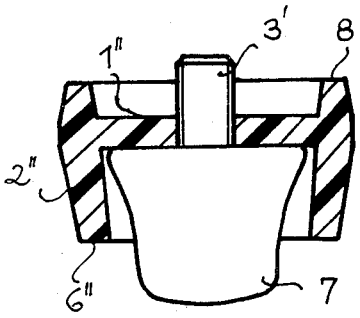
FIG. 3 is a view of a further compound structure with a further change in the design of the gripping element.

In the case of the gripping element/cleat compound structure of FIG. 2 and FIG. 3, the gripping element is fixed in place by a conventional cleat 7, for example made of synthetic resin, and having a fixing screw 3' fixed in it by molding. The gripping element of FIG. 2 is, in relation to its height, much greater in diameter than the gripping element of FIG. 1; the diameter of the flat top wall 1' is, for example at the outside 25 mm while the inner diameter of about 18 mm is substantially the same as the diameter of cleat 7 at its base face. The wall 2' or skirt of the bell-like gripping element becomes thinner in a downward direction and will be resting tightly against the outer edge of cleat 7. From this point, the skirt will be seen to have a length of about 6 mm as far as its lower edge so that about 4/5 of the length of cleat 7 comes below edge 6'.

As marked in chained lines in FIG. 2, it will be seen that the wall 2' of the gripping may be designed running even further in a downward direction, it becoming narrower as far as a generally thin edge 6. This makes the gripping element even more elastic; however, the edge may be more readily damaged by forces acting on it.

The gripping element of FIGS. 2 and 3 may be fixed in position using fixing screw 3' of cleat 7, such screw being run through a hole in the flat wall of the gripping element.

The gripping element of FIG. 3 is different to the working examples of FIGS. 1 and 2 in the essential in that it has a support edge 8 or collar, running upwards from the outer limit of its top wall 1''. The radial thickness of the collar 8 is generally the same as that of the skirt 2'', which is lined up with it. The height of collar 8 may, for example, be 3 mm. The collar 8 has the function of helping in fixing the gripping element to the sole more strongly by a sort of sucker effect so that the gripping element is positioned more safely by the fixing screw 3'.

It will be seen from FIG. 3 that the skirt 2'' of the gripping element is designed extending a relatively great distance along cleat 7 so that only half the length of the cleat will be past the edge 6''. The wall thickness of skirt 2'' is, in this case, generally equal all over. The outer face of skirt 2'' does, however, become somewhat smaller in diameter in a conical form downwards to the edge 6'' which is clearly at an angle to the outer face of the skirt. Because of the great wall length, it is not necessary for the edge 6'' to be made so thin or narrow as for example was the case with the form to be seen in chained lines in FIG. 2.

In the case of the working example of FIG. 3 as well, the diameter of the lower face of the top wall of the gripping element is generally the same as the diameter of the base-face of the cleat 7 so that cleat 7 has the wall or skirt 2'' very near to or touching it at its base-face.

The working examples of the compound structure (gripping element and cleat) to be seen in FIGS. 2 and 3 have separate cleats and gripping elements so that the gripping element may be used in each case as a further part together with a normal cleat, which may be used on its own, if desired. It is, however, furthermore possible for the cleat and gripping element to be made in one piece of the same material and to have a fixing screw.

More specially in the case of the working examples of FIGS. 2 and 3 with a greater diameter, it may be useful for a disk-like stiffening part, for example of metal, to be embedded in the top wall of the gripping element for more strongly fixing it to the sole.

I claim:

1. An exchangeable gripping structure for athletic footwear comprising, a gripping element and a cleat, said gripping element having a bell-like body including a wall of a predetermined thickness and a free edge, said gripping element being formed of an elastically-yielding material, said cleat being nested within said bell-like body of said gripping element and protruding beyond said edge thereof, said thickness of said wall of said bell-like body decreasing towards said free edge of said gripping element, said free edge of said bell-like body being uninterrupted and encircling said cleat a distance therefrom.

* * * * *

UNITED STATES PATENT AND TRADEMARK OFFICE

CERTIFICATE OF CORRECTION

PATENT NO. : 4,366,632

DATED : JANUARY 4, 1983

INVENTOR(S) : ALFRED BENTE

It is certified that error appears in the above-identified patent and that said Letters Patent is hereby corrected as shown below:

Col. 3, line 51, correct "is" second occurrence to -- in --.

Signed and Sealed this

*Third* Day of *April 1984*

[SEAL]

*Attest:*

GERALD J. MOSSINGHOFF

*Attesting Officer*

*Commissioner of Patents and Trademarks*